United States Patent [19]
Gannett
[11] 3,944,745
[45] Mar. 16, 1976

[54] SECRET SIGNALING SYSTEM WITH MEANS FOR PREVENTING KEY DISCLOSURE

[75] Inventor: Danforth K. Gannett, Mountain Lakes, N.J.

[73] Assignee: Bell Telephone Laboratories, Incorporated, Murray Hill, N.J.

[22] Filed: May 10, 1945

[21] Appl. No.: 592,963

[52] U.S. Cl. ..... 179/1.5 R; 325/32
[51] Int. Cl.[2] ..... H04K 1/02
[58] Field of Search ..... 179/1.5, 1.5 PC, 1.5 R; 178/44, 71; 250/27 GT, 27 CC

[56] References Cited

UNITED STATES PATENTS

| | | | |
|---|---|---|---|
| 1,598,673 | 9/1926 | Blackwell | 179/1.5 X |
| 2,262,838 | 11/1941 | Deloraine et al. | 178/71 K |
| 2,272,070 | 2/1942 | Reeves | 178/44.12 B |
| 2,406,977 | 9/1946 | Wendt | 179/1.5 |
| 2,423,546 | 7/1947 | Bedford | 179/1.5 |
| 2,449,467 | 9/1948 | Goodall | 179/1.5 PC |

*Primary Examiner*—T. H. Tobbesing
*Assistant Examiner*—H. A. Birmiel
*Attorney, Agent, or Firm*—H. A. Burgess

EXEMPLARY CLAIM

1. In a signaling system for transmitting with secrecy signals of varying amplitude, means to encipher said signals comprising means to produce variable key currents and means to combine said signals with said key currents to produce for transmission combination signal and key currents, and means to modify the variable key current that is sent whenever the signal has zero value.

14 Claims, 10 Drawing Figures

INVENTOR
D. K. GANNETT
BY
H. A. Burgess
ATTORNEY

INVENTOR
D.K. GANNETT
BY H. A. Burgess
ATTORNEY

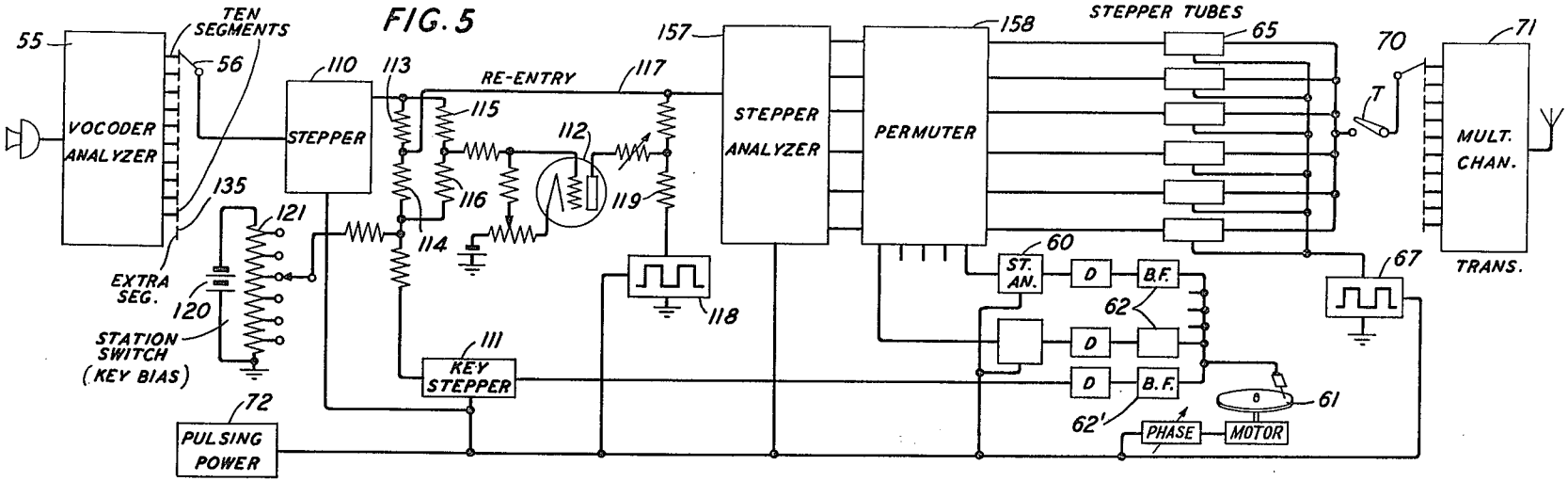
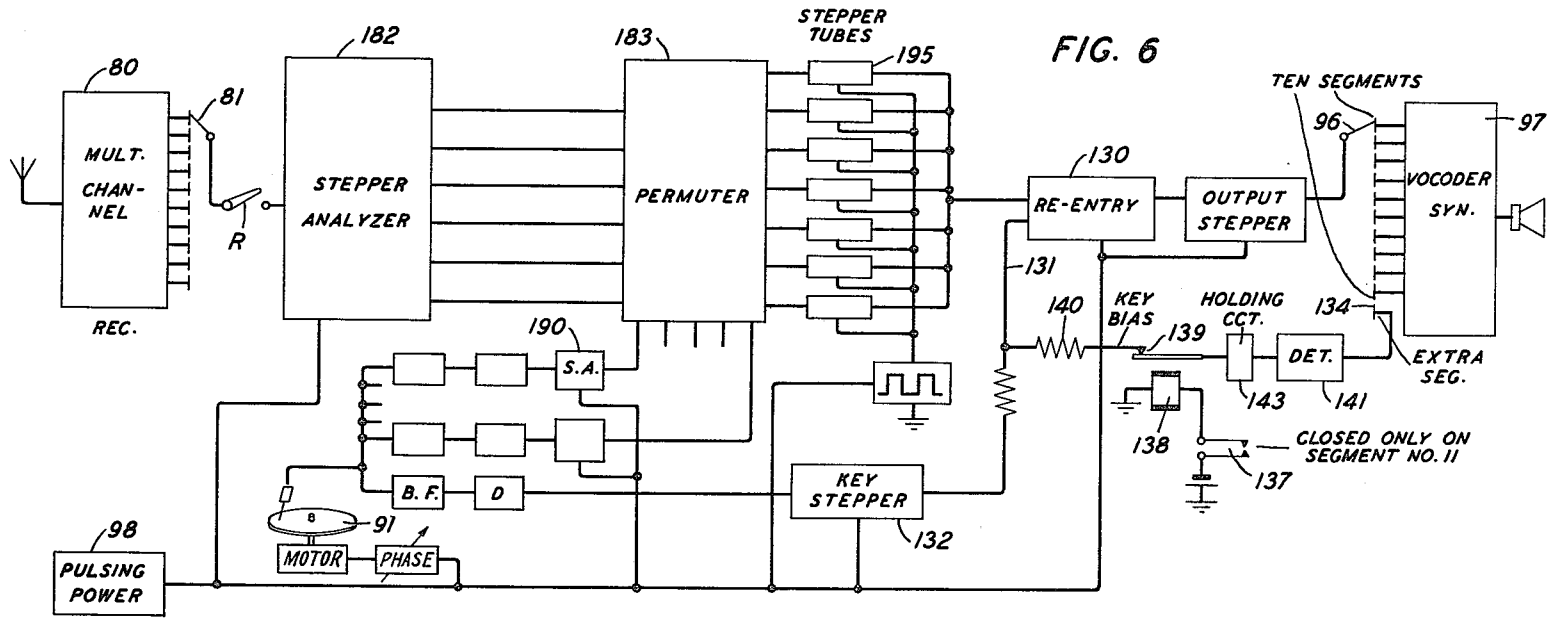
INVENTOR
D.K. GANNETT
BY
ATTORNEY

INVENTOR
D. K. GANNETT
BY H. A. Burgess
ATTORNEY

SECRET SIGNALING SYSTEM WITH MEANS FOR PREVENTING KEY DISCLOSURE

The present invention relates to secret signaling such as secret telephony in which the secrecy is dependent upon use of a secret key and in which the problem arises of preventing the escape of information regarding the key, as might happen, for instance, if the same key were used for both sending and receiving at different stations and some of the waves corresponding to zero signal were allowed to be sent out from one station while the other station is talking.

It is necessary in so-called conference connections where three or more stations carry on a conversation with one another to be able to use a key at each of the three (or more) stations which can be duplicated for receiving purposes at each of the other stations. The simplest way to do this, of course, is to use the same key at all stations for both sending and receiving. Even where a TR switch is used and each station is normally held in its R (receiving) condition and only switched to its T (transmitting) condition when speech is to be sent out, it may happen that two stations will both start talking at once. When this occurs there will be short intervals between words or syllables when pure key is sent from one of the stations while speech is sent from another, giving an opportunity for a monitoring station to, in effect, subtract one transmitted wave from the other and perhaps obtain a clue to the key.

The general object of the invention is to facilitate intercommunication between stations using a key for making the transmission secret without permitting the escape of information as to the key in use.

A further object is to produce a modification in or variation of the key wave that is sent from a station whenever the signal has zero value.

A further and related object of the invention is to disguise or alter in individual manner the key that is sent out from each station during the pauses in speech or between syllables so that a different key is sent out from each station during such pauses.

Other and related objects of the invention and its various features will appear more fully from the following detailed description taken in connection with the drawing in which:

FIGS. 5 and 6 show respectively in similar block schematic form an alternative type of transmitting and receiving station.

Figure 1:
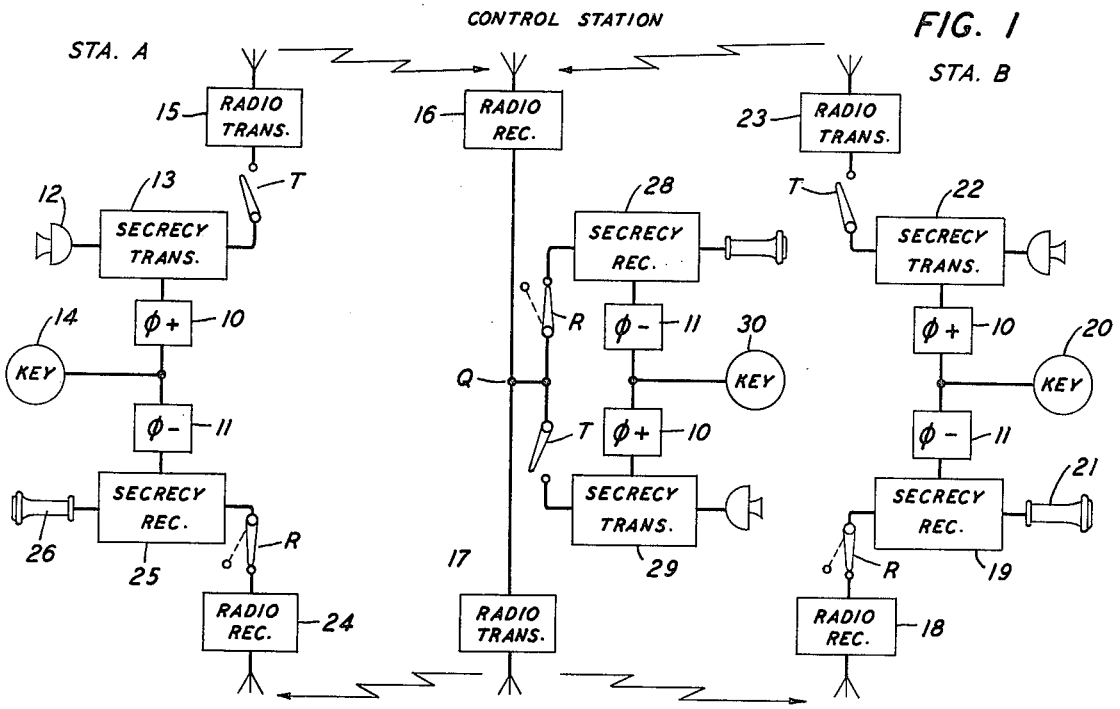
FIGS. 1 and 2 show in block schematic diagram form how a control station may be used in connection with outlying stations for conference conversations.

In the system of FIG. 1 it is assumed that any one of several outlying stations, of which two are indicated at A and at B, may communicate with any one or more of the others through the medium of a centrally located control station. Each outlying station operates only to and from the control station. Conversations between two outlying stations such as A and B, therefore, pass through the control station. Two radio frequencies are required, one for transmission from the control station to the outlying stations and another for transmission from all of the outlying stations to the control station. It is necessary that there be two frequencies since the radio transmitter and receiver at the control station must be simultaneously operative.

The general plan of an outlying station is similar to that of the control station except that at the latter station the voice frequency circuits are bridged on to a through connection from the radio receiver to the radio transmitter. TR switches, referred to sometimes as push-to-talk switches, are shown at each station at T and R. At each outlying station these switches are so placed as to interrupt the radio branches while in the control station they interrupt the audio branches. A source of duplicate key currents is used at each station for both coding outgoing speech and decoding incoming speech. In FIG. 1 it is assumed that the same key currents are used at each station for both sending and receiving. Phase shifters 10 and 11 are interposed in the connections between the source of key waves at each station and the secrecy apparatus. The devices 10 are used to advance the phase of the key currents that are applied to the transmitting secrecy apparatus while the devices 11 are used to retard the phase of the key currents that are applied to the receiving secrecy apparatus. In this way full compensation can be made for the effects of transmission path delays between stations so far as their effects upon synchronizing the key wave sources is concerned.

At each station the T and R switches are mechanically tied together so that whenever T is closed R is opened and vice versa. The normal condition at each station is for T to be open and R closed. If station A is to talk to station B, the T switch at station A is closed and the R switch at that station is opened. Speech spoken into microphone 12 is enciphered in secrecy transmitter 13 by use of key currents from key source 14 (in a manner to be more fully disclosed hereinafter) and the coded speech is impressed upon the radio transmitter 15, is sent out thereby and is picked up on the radio receiver 16 of the control station. Thence it is sent out over radio transmitter 17 to the radio receiver 18 of station B, and, since the R switch thereat is normally closed, is sent into the secrecy receiver 19 where it is deciphered by means of key waves from source 20 which are in proper phase coincidence with the received waves to permit of proper decoding. The recovered normal speech waves are heard in receiver 21.

For transmitting in the opposite direction, from station B to station A an analogous path is used through 22, T, 23, 16, 17, 24, R and 25 and 26.

In either case the control station can monitor the conversation by means of its own receiving secrecy apparatus 28 or can talk to the outlying stations over its transmitting secrecy apparatus 29 and radio transmitter 17, by placing its T and R switches in the appropriate positions. Key wave source 30 supplies the necessary key currents at the control station for enciphering and deciphering.

The nature of the secrecy transmitting and receiving apparatus will be disclosed hereinafter in connection with the more detailed figures.

By using a common control station for a group of outlying stations, the problems of synchronizing the key currents at the various stations is solved each outlying station only needs to transmit to and receive from one station, the control station, even though a conference connection is being used involving three or more outlying stations such as A, B and C. If B is near A but C is farther away, and if each station should try to communicate directly with both other stations without passing through a common control station, it will be seen that the keys would not be in synchronism at all three stations because of unequal path delays between stations. In FIG. 1, however, the phase shifters at each outlying station can be adjusted to bring the key of that station into synchronism with respect to the control station. For example, point Q can be taken as the point of reference phase for the entire system. Considering any outlying station, phase shifter 10 can be set to advance the phase of the key waves applied to the transmitter of that station by the right amount to compensate for the path delay from that station to the point Q. Also the phase shifter 11 of such outlying station can be adjusted to retard the key applied to its receiver by an amount equal to the path delay between point Q and such point of application of the key at the outlying station. If this is done in the case of phase shifters 10 and 11 of all stations, including the control station, all stations are synchronized so that the keys are applied in the right phase to encipher and decipher the massage.

Figure 2:
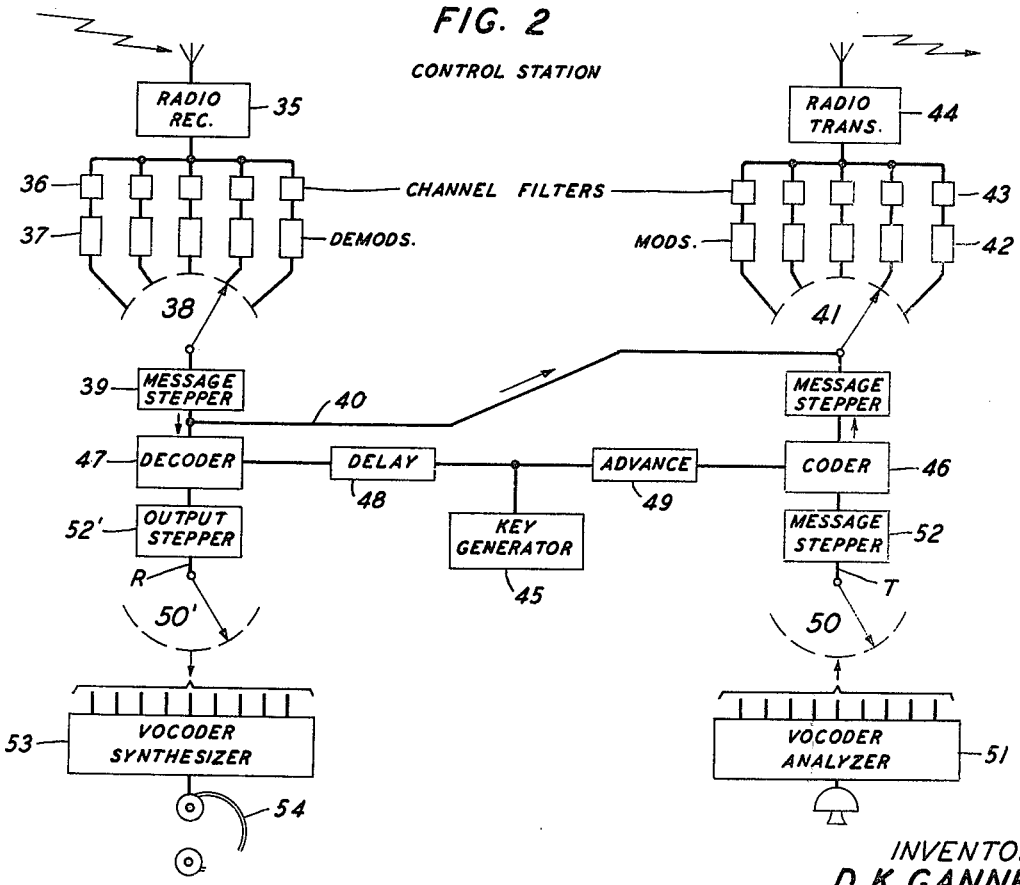

FIG. 2 discloses an arrangement which may be used used at the control station for giving a better repetition of the signals between outlying stations. The arrangement of FIG. 1 is suitable for relatively short radio links when fading is not encountered to a significant degree. For longer links where fading may be present it is desirable to reform the signals at the control station so that they are sent out without such distortion as may have occurred due to fading in the next preceding link. In FIG. 2 the signals are reformed by the use of steppers in the low frequency transmission channels.

The signals on the output side of the radio receiver 35 are separated by the channel filters 36 into individual channel branches which may comprise ten, for example, or other suitable number. Five such channels are specifically indicated in the drawing. Each channel filter 36 is followed by a demodulator circuit 37 for recovering the low frequency signal. A distributor of suitable type shown at 38 samples these demodulated signals in the various channels in rotation and applies them to the common message stepper 39.

This message stepper 39 may be of the type disclosed in an application of R. L. Miller, Ser. No. 542,975, filed June 30, 1944, which application also discloses type of distributors that would be suitable for use at 38 and elsewhere in the FIG. 2 circuit under discussion. The message stepper comprises as many gas-filled tubes as there are steps, other than the step O, to be identified, for example, five tubes having graduated grid biases such as to cause the tubes to fire on a selective basis as regards amplitude of impressed signal. That is, one tube fires or two tubes fire together or three tubes, etc., depending upon the instantaneous value of the applied signal. The output current from the stepper, therefore, varies in equal steps over the range zero to five steps. The timing of the operation of the message stepper in relation to the distributor and other parts of the system is effected in the manner disclosed by Miller, such that the wave in the output of stepper 39 comprises equal length pulses having as stated equally stepped amplitudes.

These pulses are in this manner reformed and are rendered suitable for transmission over the next radio link. They are, therefore, carried across by means of conductor 40 to the transmitting distributor 41 leading to the modulators 42 and channel filters 43 for transmission into the radio transmitter 44.

The enciphering and deciphering of the signals at the control station may be carried out in the manner disclosed in the Miller application. For this purpose a key generator 45 supplies key currents to vocoder 46 and decoder 47 through suitable phase delaying or phase advancing networks 48 and 49 as explained in the case of FIG. 1. Distributor 50 samples the vocoder currents in the output of the analyzer 51 and applies them in rotation to the outgoing message stepper 52 while receiving distributor 50' applies the output pulses from the stepper 52' to the input channels of the vocoder synthesizer 53 for enabling reception of the speech or signals at 54. A T-switch and an R-switch can be inserted in the common conductor portion of the circuit at any point such as at two points indicated T and R in the figure.

As noted heretofore, if two of the stations in a system such as disclosed in FIG. 1 or assumed in FIG. 2 close their 7 switches and talk at the same time, it is possible that a clue may be obtained to the secret key waves due to the fact that when the signal is zero, as between words or syllables, the key wave that would be picked up by a monitoring station from the two stations they are assumed to be transmitting would be identical if the pauses in the case of both stations occur together. If the pauses do not occur together one wave may be subtracted from the other and directly yield the signal. Methods for avoiding such a possibility in a conference system are disclosed by way of example in the circuit figures now to be described.

Figure 3:
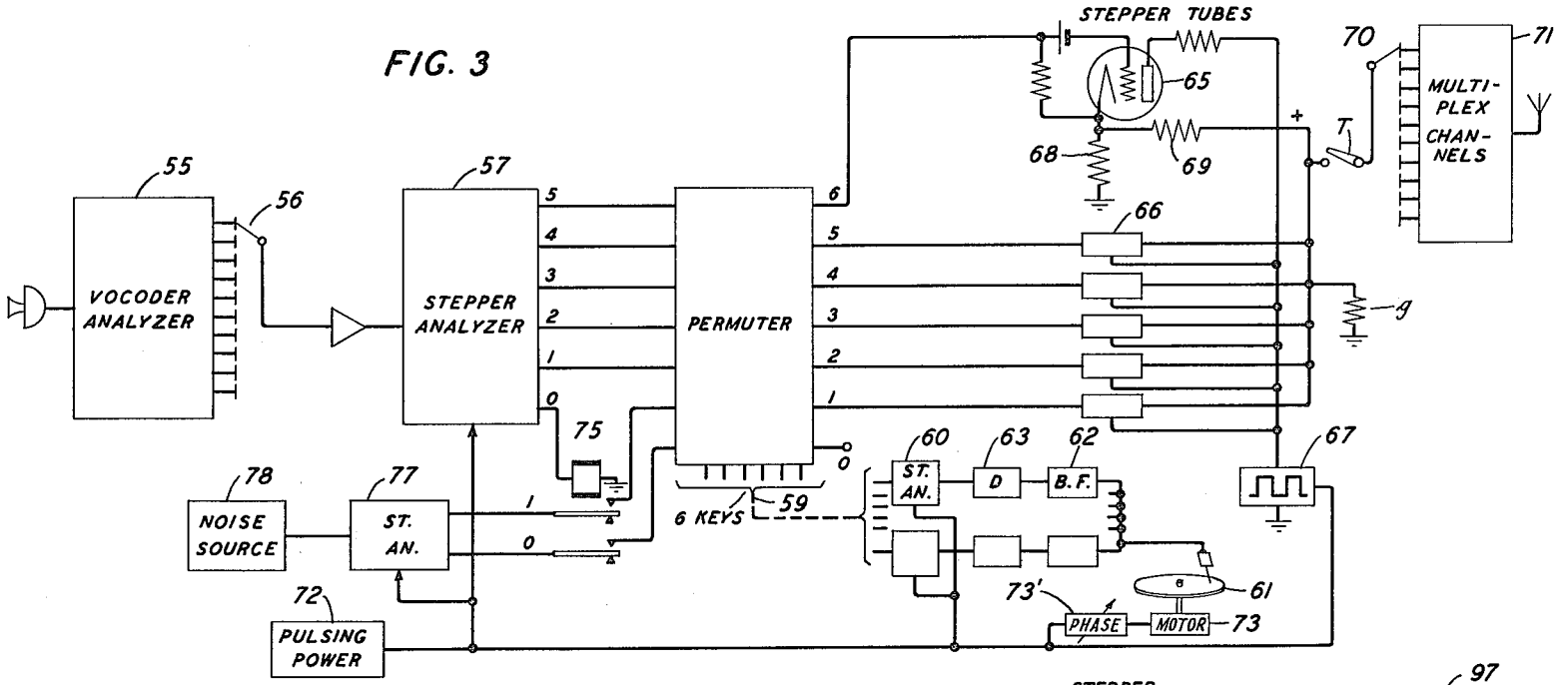
FIG. 3 is a block diagram of a transmitting station suitable for use as an outlying station in a system of the type shown in FIG. 1 for example.

FIG. 3 shows a secret transmitting terminal which may follow the general arrangement disclosed in the Miller application referred to except that in the present case a permuter is used for enciphering the signal and auxiliary means to be described are used for preventing disclosure of the nature of the key wave in case two or more terminals should talk at the same time. As in the Miller application, the vocoder analyzer 55 is provided with a distributor diagrammatically indicated at 56 but which may be of the same type as shown by Miller and which connects the vocoder channels in rotation to the input of a stepper analyzer 57. This stepper analyzer may be of the type disclosed in my copending application Ser. No. 592,962 filed May 10-1945. It is similar to the message stepper disclosed by Miller but is provided with relays or other means for causing a voltage to be impressed upon a different output lead for each step value of the message current. Six such leads are shown on the output side of the stepper analyzer 57 and are designated 0, 1, 2, 3, 4 and 5.

The permuter 58 may be of the type shown in my copending application referred to. While it is here shown as a rectangle it will be clear from the disclosure in my copending application that six permuters are used, each for permuting a different number of leads, and these are assumed to be included in the rectangle 58. These would be a $2 \times 2$ permuter, a $3 \times 3$ permuter, a $4 \times 4$ permuter, a $5 \times 5$ permuter, a $6 \times 6$ permuter and a $7 \times 7$ permuter connected in tandem. These require six different keys which are applied at 59, derived from phonograph record 61. These keys are recorded as modulations of six different frequency carrier waves. Six filters are shown at 62 for separating the six keys which are then rectified at 63 and applied to six stepper analyzers 60. One of these stepper analyzers has seven relays and seven output leads which provide the key for the 7 × 7 permuter. Each other stepper analyzer has one less relay and output lead for supplying the next permuter, the smallest number of such output leads being two. The six short lines at 59 and also those shown emerging from the stepper analyzers 60 are each intended to represent a plurality of leads, the number varying from two to seven.

As explained in detail in my copending application referred to, the operation of the permuter 58 is to set up in its output leads, one at a time, designated 0, 1, 2, 3, 4, 5 and 6, a voltage in response to application of a voltage from the individual output leads of the stepper analyzer 57, and to distribute such voltage over the permuter output leads on a substantially random basis. For example, a voltage appearing on output lead 5 of stepper analyzer 57 has a substantially equal chance of impressing a voltage on any given output conductor leading from the permuter 58. This is also true of each of the other input conductors. The randomness of distribution depends, of course, upon the randomness of the key and this can be made as nearly random as desired by means known in the art.

Since any lead in the output of the permuter has the same value of voltage applied to it when such lead is chosen, it is necessary to convert these voltages on the various leads into voltages having different step values for transmission from this terminal. This is accomplished by means of the stepper tubes one of which is shown at 65 and the others indicated by the boxes 66. These stepper tubes are gas-filled tubes which remain quiescent unless positive voltage is applied to their input terminals to overcome the normal negative bias on the grid at the time the pulsing power supply 67 applies positive voltage to the stepper tube plate. When this occurs the tube fires and transmits current through the resistor 68. The voltage across resistor 68 is applied via series resistors 69 and *y* to the input terminal of the output distributor 70 leading to the multiplex transmitter 71. By differently proportioning the resistors 68 and 69 in individual channels with respect to each other and resistance *y* each channel may be made to apply a different step value of voltage to the output distributor 70.

A source of pulsing power 72 is shown as supplying energizing and timing waves to the stepper analyzers 57, 60 and 77 (to be described) and to the motor 73 which drives the record 61. The phase or time relation of the keys derived at 61 is adjustable by means of phase shifter 73 in the driving circuit of motor 73.

The special means for preventing disclosure of the key wave in case a plurality of stations transmit at the same time will now be described. The zero output lead of stepper analyzer 57 is not carried through to the permuter 58 but is carried to ground through a relay 75. Whenever the signal is zero a voltage is applied by the stepper analyzer to this zero lead. Relay 75 is, therefore, operated each time the stepper analyzer puts out a pulse on the zero lead. Relay 75 attracts its armatures and applies a voltage to the lowermost pair of input terminals of the permuter 58 from a special stepper analyzer 77 operated from noise source 78. The noise source 78 applies a highly irregular and unpredictable wave to the input of the stepper analyzer 77 which is actuated under control of the pulsing power from source 72 to sample this highly irregular wave at intervals. The stepper analyzer 77 is similar to stepper analyzer 57 except that it distinguishes only two step values of the input waves and by means of two relay contacts energizes one or the other of its two output leads, depending upon whether the noise wave has a value greater or less than a given amount at the instant of sampling. The result is that during pauses in the speech the permuter 58 receives input voltages over either of the lowermost two input leads and these are distributed under control of the key wave over the seven permuter output leads in a similar manner to the signal. The zero output lead from the permuter is left open or unterminated, thus giving the appearance of transmitting normal signals since occasional zero values in the transmitted wave will appear. Since the noise wave produced in each station will always differ from that produced in any other station, the waves sent out when the speech is zero will always differ from station to station and nothing can be learned, therefore, from comparing simultaneous transmissions.

Figure 4:
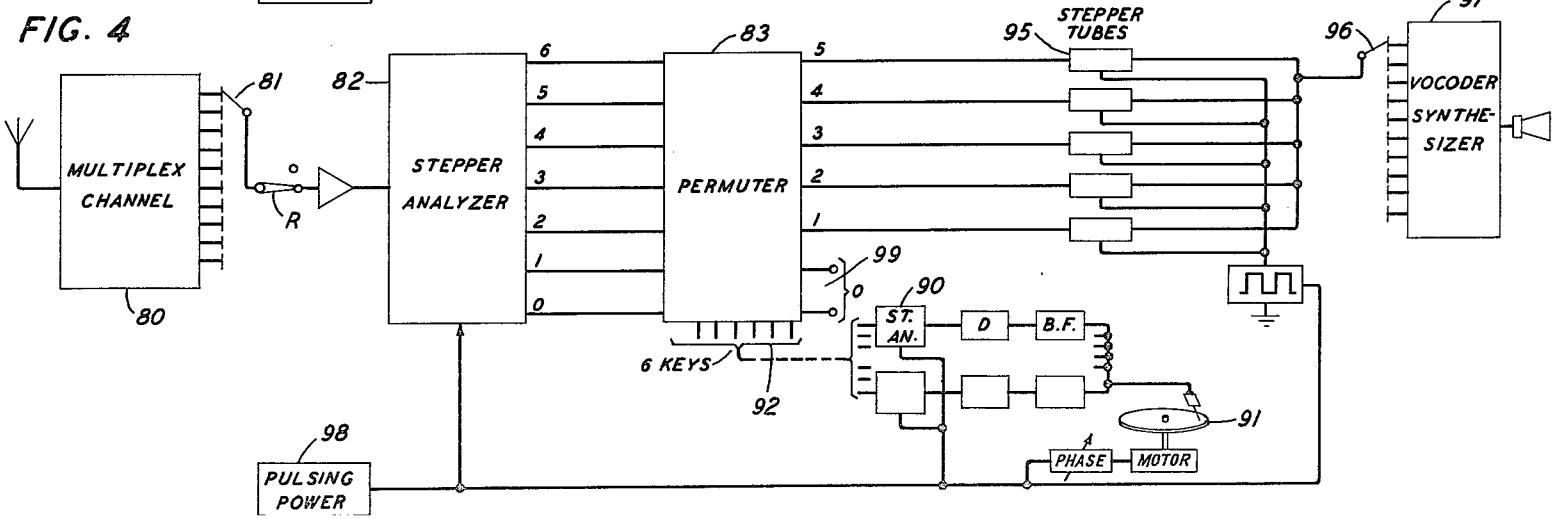
FIG. 4 is a similar diagram of the receiving station that may be used in conjunction with the transmitting station of FIG. 3.

Referring to the receiving terminal of FIG. 4, the waves transmitted from the station shown in FIG. 3 are received at 80 and applied by means of distributor 81 to the stepper analyzer 82. Duplicate key waves are supplied from duplicate record 91 to the stepper analyzer 90 which supplies six keys to the permuter input leads 92 identical with the keys supplied at 59. The permuter 83, therefore, supplies to its output leads 1 to 5 deciphered currents corresponding to those existing on the leads 1 to 5 in the output of stepper analyzer 57. It will be understood that these voltages have the same value on all leads but that the leads on which a voltage individually appears correspond with one another. These five output permuter leads are connected to stepper tubes 95 which are similar to the tube 65 and are arranged to deliver stepped values of output current to the output distributor 96 for application to the individual channels of the vocoder synthesizer 97. Pulsing power supply for this terminal is derived at 98 running in synchronism with the pulsing power supply 72 at the distant station.

The lowermost two leads 0 and 1 in the output of the stepper analyzer 82 are carried into the permuter 83 which is provided with a corresponding pair of output leads at 99. It will be observed that the only voltages which appear on the output leads 99 are those corresponding to the voltages impressed at the transmitting station from stepper analyzer 77 under control of relay 75 and that these voltages contain no information as to the signal except that the signal has the value 0. These two leads are, therefore, merely left unterminated at 99 since all information as to the signal values other than zero are carried by the permuter signal leads 1 to 5.

It is seen from the above description that the result of using the noise source 78 and stepper analyzer 77 is to apply a certain amount of useless information as regards the signal, which information is discarded at the receiver. The character of the useless information differs from station to station but the message can be received at any station of the system. This information, which is useless so far as the signal is concerned, has the effect of transmitting a different "raw" key from each station when the signal has zero value and therefore prevents discovery of the key by comparison of simultaneous transmission from two or more stations of the system.

Reference will now be made to FIGS. 5 and 6 which show a different means for preventing escape of information concerning the key. In FIG. 5 the vocoder analyzer 55 and distributor 56 at the input end of the system and also the stepper tubes 65, distributor 70 and transmitting terminal 71 at the output end of the terminal may be the same as in the case of FIG. 3. The stepper 110 and reentry 112 may be identically the same as the message stepper and reentry disclosed in the Miller application above referred to. Reentry 112 is followed by stepper analyzer 157 which, except for the number of output terminals used, may be the same as stepper analyzer 57 of FIG. 3. The permuter 158 may likewise be the same as permuter 58 of FIG. 3 except for the number of conductors used.

The key waves which are derived from the record 61 contain six keys five of which are separated by means of the five band filters 62 and the sixth is selected by filter 62'. Filters 62 supply keys to the stepper analyzers 60 for energizing the key input terminals of the permuter 158. The key inputs have, respectively, 2 leads, 3 leads, 4 leads, 5 leads and 6 leads for the five individual permuters assumed to be included in box 158. filter 62' supplies its key to the key stepper 111, which may be the same in construction as the message stepper 110.

The manner in which the output currents of the message stepper 110 and the key stepper 111 are applied to the reentry 112 is the same as that disclosed in the Miller applications. Each stepper produces pulses which are negative in the sense that they represent diminutions of current from the maximum positive value corresponding to zero input of message and key. These pulses are combined additively in the high resistance circuits 113, 114 and 115, 116. The combined message and key pulses are applied directly over conductor 117 to the input of the stepper analyzer 167. They are also applied to the grid of the reentry circuit 112 whose plate is supplied with pulsing power from source 118. This gas tube 112 has its negative grid voltage adjusted to the point where the tube fires each time that no reentry is to take place, and the summation voltage steps from the key stepper and message stepper, combined with the voltage from 118 flowing through resistor 119 in the plate circuit of the tube 112, is applied to the input of the stepper analyzer 157. If reentry is to take place, tube 112 fails to fire since the summation-message-plus-key steps throw the voltage applied to the grid too far in the negative direction to permit tube 112 to fire, and the resulting absence of current flow through resistor 119, in effect, subtracts a constant voltage from the pulse voltage on conductor 117 as compared with the no-reentry case. This action is all in accordance with the disclosure of the Miller application.

In accordance with a feature of the present invention a battery 120 and a potentiometer 121 are provided with voltage taps corresponding to steps of key voltage for applying a fixed amount of bias to the key appearing in the output of the key stepper 111. The position of the slider on this potentiometer 121 is made different at each station of the system so that in the illustrated case a maximum of six stations is accommodated. The effect of applying this steady direct voltage bias is to change by a fixed number of steps the voltage applied at any instant to the input of stepper analyzer 157. This has the effect of altering the output conductor of the stepper analyzer that has a voltage applied to it at any particular moment. When the signal is zero, therefore, each station sends out a different wave since the wave sent out is determined not only by the key wave but by the steady bias which differs from station to station. An extra segment 135 on distributor 56 allows an indication of this bias to be transmitted to the distant station once in each cycle of the distributor. Segment 135 is unconnected to the message circuits so that in this segment interval only key plus bias is sent. By subtracting the keys at the receiver, the bias value is obtained.

As in the Miller application the pulsing supplies 118 and 67 as well as those used for the stepper analyzers may be properly phased with respect to each other and this is also true of the driving means for distributors 56 and 70. For example, the timing of the reentry circuit is adjusted to sample the output pulses from stepper 110 at about their middle point. The stepper analyzer 157 samples the reentry pulses at about their middle point. This relation also holds for the stepper tubes 65 so that the distributor 70 must lag behind the distributor 56 by a fixed amount. Provision for securing this result is fully disclosed in the Miller application. These considerations apply also to FIGS. 3, 4 and 6.

Referring to FIG. 6, which shows a receiving terminal for receiving and deciphering the message sent out from the station in FIG. 5 or from a similar station, the receiver 80, distributor 81 and also the vocoder synthesizer 98 and distributor 96 may be of the same types as those disclosed in FIG. 4. The stepper analyzer 182 and the permuter 183 may be similar to 157 and 158, respectively, of FIG. 5. Stepper tubes 195 may be similar to those at 65 of FIG. 5. Reentry circuit 130 may be similar in construction and operation to 112 of FIG. 5. As a result of the action of the system up to the output of the stepper tubes 195 there are applied to the reentry 130 partially deciphered message pulses from the stepper tubes 195 which would be further deciphered by combination with the key pulses supplied to the reentry over conductor 131. The key stepper 132 supplies key pulses identical with those supplied in the output of key stepper 111 at the transmitting station. It is necessary in order the proper pulses on conductor 131 to apply also a proper amount of direct current bias. This is accomplished in the following manner.

The distributor 96 is provided with an extra segment 134 corresponding to the eleventh segment at 135 of FIG. 5. Since, as stated, segment 135 is a block segment having no signal voltage applied to it, the only voltage that appears on segment 134 is that due to the direct current bias applied at the transmitting station. Whenever the brush of the distributor passes over segment 134 a pulse of voltage is sent into detector 141 and holding circuit 143. A pair of contacts is provided at 137 to cause actuation of a relay 138 only during distributor time 11. This relay attracts its armature and opens at contact 139 a connection normally existing from conductor 131 through resistor 140 to the output of the detector 141. This connection is normally applying to conductor 131 from holding circuit 143 the necessary direct bias voltage for decoding the message but at the instant when the brush is passing over segment 134, contacts 137 are closed causing the connection to be opened at 139, and the key voltage alone without any direct bias is applied to conductor 131. This causes a voltage corresponding to the direct bias voltage to appear on the extra segment 134. The holding circuit 143 may comprise a shunt capacity in a high resistance circuit, such as to store up the voltage for subsequent use. Relay 138 allows contact 139 to remain closed while the distributor 96 is passing over the remaining segments, thus applying to conductor 131 the bias voltage stored in the holding circuit 143. In this way a bias voltage is automatically applied together with the key at the receiving station and is made to have the proper value for deciphering the signal regardless of which of the different transmitting stations is sending out the message. Contacts 137 may be closed by a rotary brush or cam in the case of a rotating brush type distributor but if a relay type distributor is used of the type shown in the Miller application, either the contacts 137 may be springs actuated from a distributor relay or the relay 138 may itself be the distributor relay referred to.

By way of further illustration, other general methods of concealing the key when the speech is zero are shown in FIGS. 7A and 7B, and 8A and 8B. In each of these figures only the high speed portion of the terminal occurring between the input and output distributors is shown since the apparatus on the other side of the distributors, that is not shown in these figures, may be the same as shown in the system of FIGS. 3 to 6. The distributors identified as $D_T$ are the distributors which face the voice terminal whether this be the vocoder analyzer of the vocoder synthesizer. The distributors $D_L$ are those which face the line of transmission channel between stations.

Figure 7A:
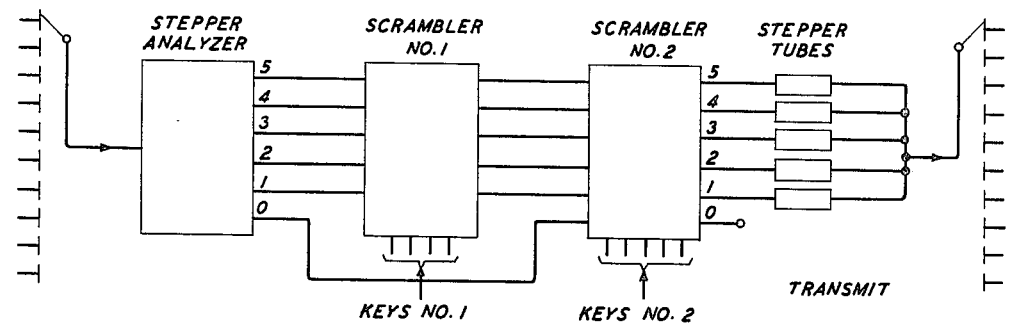
FIGS. 7A, 7B, 8A and 8B are block schematics of modified types of stations.

Referring to FIG. 7A which represents the transmitter, the stepper analyzer provides for a six-valued signal having steps 0 to 5, inclusive. The leads for steps 1 to 5 are carried through scrambler No. 1 while the lead for the zero signal by-passes scrambler No. 1 and is carried through scrambler No. 2 along with the five leads from scrambler No. 1. On the output of scrambler No. 2 the zero lead is unterminated while the other five leads pass through stepper tubes to the brush of the output distributor.

Scrambler No. 1 requires four keys assuming this scrambler to be constructed similarly to the permuters of the previous figures. Each of the key leads indicated for this scrambler would therefore comprise a plurality of conductors varying in number from 2 to 5. Similarly the keys for scrambler No. 2 are supplied over five groups of conductors varying in number from 2 to 6. The keys No. 1 and keys No. 2 may be derived in any suitable manner such as from a phonograph record as fully disclosed in the previous figures.

As noted above, the zero lead from the stepper analyzer does not pass through scrambler No. 1. Therefore when no speech is present, no information whatever is divulged regarding the nature of scrambler No. 1 and the keys No. 1 controlling it. By passing the zero lead through scrambler No. 2, however, zeros occur in the final output waves with the same average frequency of occurrence during talking as during non-talking periods.

Figure 7B:
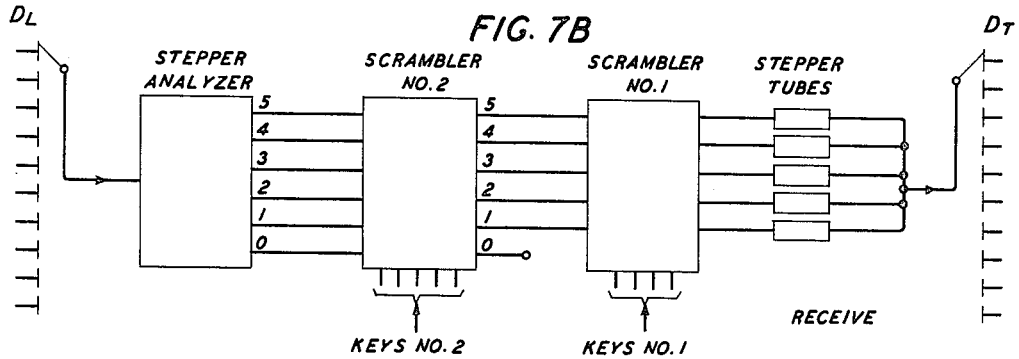

Referring to the receiver represented in FIG. 7B, the stepper analyzer which recognizes the six step values 0 to 5, is connected to scrambler No. 2 the zero lead of which is unterminated. The other five leads of scrambler No. 2 pass into scrambler No. 1 which completely restores the original signals in the output stepper tubes leading to the terminal distributor.

Figure 8A:
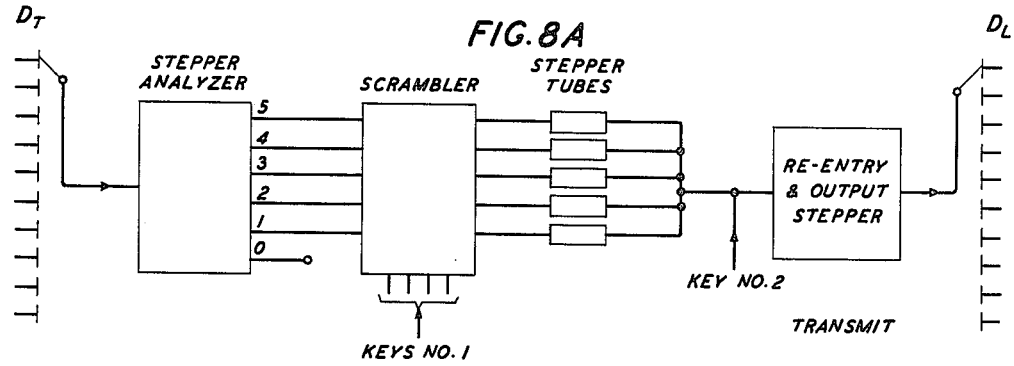
Figure 8B:
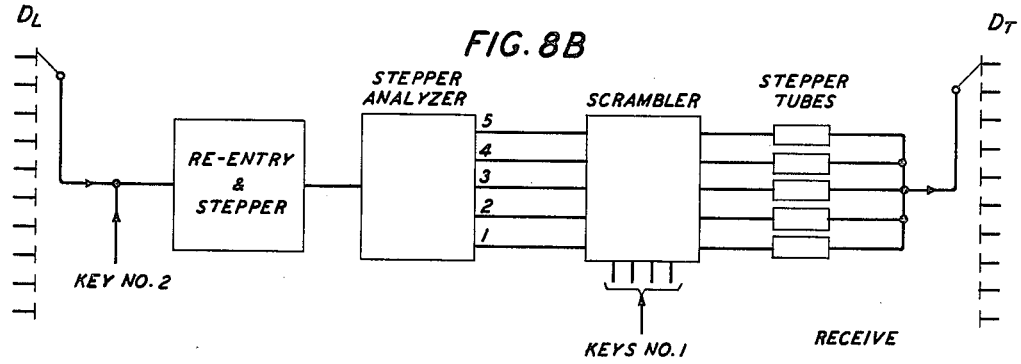

Referring to FIGS. 8A and 8B, these differ from the systems shown in FIGS. 7A and 7B mainly by the fact that the second scrambler is replaced by a key-adding and reentry circuit of the same general type as disclosed in FIGS. 5 and 6 (but without the station identifying bias of those figures). Key No. 2 in FIGS. 8A and 8B can be derived similarly to the keys for the reentry circuits in the case of FIGS. 5 and 6. It is thought that the operation of these circuits requires no further description but follows clearly from the description of the previous figures.

While for illustration the keys have been described as derived from phonograph records they may be derived in any other suitable manner, for example, from a disc machine of the type disclosed and claimed in A. E. Melhose application, Ser. No. 555,912, filed Sept. 27, 1944.

The invention is not to be construed as limited to the specific forms of embodiment that have been disclosed since these are to be regarded as illustrative. The scope of the invention is defined in the claims.

What is claimed is:

1. In a signaling system for transmitting with secrecy signals of varying amplitude, means to encipher said signals comprising means to produce variable key currents and means to combine said signals with said key currents to produce for transmission combination signal and key currents, and means to modify the variable key current that is sent whenever the signal has zero value.

2. In a signaling system for transmitting with secrecy signals of varying amplitude, means to encipher said signals comprising means to produce variable key currents and means to combine said signals with said key currents to produce said transmission combination signal and key currents, and means to impress variations upon the key current in response to zero signal value.

3. In a plural station communication system, means at each station to encipher signals for secret transmission to the other station or stations of the system including sources of duplicate key currents at the several stations together with means for combining said key currents with signals to be sent, and means for transmitting from each station in response to zero signal value a key current having a characteristic individual to that station and different from that of any other of said stations, each key current having a characteristic which varies in highly irregular and substantially fortuitous manner.

4. In a secret communicating system in which outgoing signals are enciphered by means of key waves and incoming signals are deciphered by means of key waves, a source of duplicate key waves at each station for use in enciphering and diciphering signals, and means at each station operating in response to pauses between outgoing signal elements for superposing variations upon the key waves thereat, said means causing the variations so superposed at any station to differ in distinguishable manner from the variations superposed at the other station or stations.

5. In a secret communication system for signal currents having a finite number of different magnitudes one of which is zero, means to encipher said signal currents comprising means to convert each value of signal current other than zero to current of some one of a finite number of magnitudes on a fortuitous basis and means operative when the signal current has zero value for variably producing output current of some one of said finite number of magnitudes.

6. In a secret communication system for signals, means to translate signal values other than zero into pulses, automatic enciphering means for enciphering said pulses, meanns to translate zero value of signal into pulses of any one of a plurality of different characters, means to determine on an irregular basis the character of pulses into which the zero signal value is so translated, and means to impress said last pulses upon said enciphering means.

7. A system according to claim 6 in which said last means includes a source of resistance noise and means responding to the instantaneous amplitude of the noise waves from said source for determining the character of the pulses into which zero signal value is translated.

8. In a secret communication system having a plurality of stations, means to send between stations a succession of designations of instantaneous signal values, means at each station to encipher the signals, means at each station to decipher received signals, means to produce a different designation of zero signal value to be sent from each station and means at all other stations for receiving said last designations and translating them into zero received signal value.

9. In a signal privacy communication system, means at a station to supply a variable key with which to encipher signals for transmission from such station, means to determine a characteristic of said key, means to transmit signals enciphered by said key in each of a succession of definitely timed intervals, and means for periodically sending in one such timed interval a special enciphered signal indicating the characteristic of said key that is used for enciphering said signals.

10. In a signal privacy communication system, means at a station to encipher signals in accordance with a secret key for transmission, means to determine a characteristic of said key, means to encipher elements of said signals in successively timed intervals in accordance with said secret key, and means for sending from time to time in one of such intervals an enciphered indication of the characteristic of said key that is used for enciphering signal elements sent in other of said intervals.

11. In a secret signal communication system, a source of variable key currents at a station, means to encipher signals in accordance with said key currents for transmission, means to impress a variation on said key currents to alter their character, a plurality of communication channels for transmitting the enciphered signals, a special communication channel, and means to transmit over said special channel indications of the variations impressed upon said key currents.

12. In a secret signal communication system for signals having a definite number of discrete values including zero, transmitting means for said signals including means to translate each signal value other than zero into a current of definite character for transmission, means to provide additionally a plurality of different characters of currents, and means controlled in response to zero value of signal for automatically selecting any one of said different characters of currents for transmission.

13. A system as claimed in claim 12 in which said last means includes a source of fortuitously varying currents and means controlled in response to zero signal value and in accordance with the instantaneous value of the currents from said source for selecting one of said different characters of currents.

14. In a signal privacy communication system, means at a sending station for enciphering outgoing signals in accordance with a secret key wave, means to generate any one of a given plurality by key waves of different character at said station for use in enciphering said signals, means to select a key wave for use, and means for sending to a distant station in time intervals when the signal has zero value an indication of the key wave that has been selected for use.

* * * * *